US009269257B2

(12) United States Patent
Huang et al.

(10) Patent No.: US 9,269,257 B2
(45) Date of Patent: Feb. 23, 2016

(54) METHOD AND SYSTEM FOR REMINDING READER OF FATIGUE IN READING WHILE USING ELECTRONIC DEVICE

(71) Applicant: NATIONAL CHENG KUNG UNIVERSITY, Tainan (TW)

(72) Inventors: Yueh-Min Huang, Tainan (TW); Chia-Ju Liu, Tainan (TW); Chia-Hung Lai, Tainan (TW); Yen-Ning Su, Tainan (TW); Chia-Cheng Hsu, Tainan (TW); Yu-Cheng Chien, Tainan (TW); Tsung-Ho Liang, Tainan (TW); Tzu-Chien Liu, Tainan (TW); Fu-Yun Yu, Tainan (TW); Yu-Lin Jeng, Tainan (TW)

(73) Assignee: National Cheng Kung University, Tainan (TW)

( * ) Notice: Subject to any disclaimer, the term of this patent is extended or adjusted under 35 U.S.C. 154(b) by 115 days.

(21) Appl. No.: 13/946,069

(22) Filed: Jul. 19, 2013

(65) Prior Publication Data

US 2014/0333435 A1 Nov. 13, 2014

(30) Foreign Application Priority Data

May 13, 2013 (TW) ..... 102116879 A

(51) Int. Cl.

| | |
|---|---|
| ***G08B 23/00*** | (2006.01) |
| ***G08B 21/24*** | (2006.01) |
| ***G08B 21/06*** | (2006.01) |

(52) U.S. Cl.

CPC ..... *G08B 21/24* (2013.01); *G08B 21/06* (2013.01)

(58) Field of Classification Search

None

See application file for complete search history.

(56) References Cited

U.S. PATENT DOCUMENTS

| | | | | |
|---|---|---|---|---|
| 8,847,885 | B2 * | 9/2014 | Huang | 345/156 |
| 2008/0117323 | A1 * | 5/2008 | Sakamoto et al. | 348/333.01 |
| 2011/0292319 | A1 | 12/2011 | Cole | |
| 2012/0092172 | A1 * | 4/2012 | Wong et al. | 340/575 |

(Continued)

FOREIGN PATENT DOCUMENTS

| | | | |
|---|---|---|---|
| CN | 101794228 | A | 8/2010 |
| CN | 102723003 | A | 10/2012 |
| TW | M285339 | | 10/1994 |
| TW | 201209605 | A | 3/2012 |

(Continued)

OTHER PUBLICATIONS

Communication of the Taiwan Patent Office Regarding a Counterpart Foreign Application Dated (Taiwan Year 103) Oct. 22, 2014.

*Primary Examiner* — Curtis King

(74) *Attorney, Agent, or Firm* — Rosenberg, Klein & Lee

(57) ABSTRACT

The method and system for reminding readers of fatigue in reading while using electronic devices are revealed. First use a reading speed calculation module to detect user's reading speed within a period of time when the user is using an electronic with a display to read. The reading speed is related to pages being turned or the amount of words being read. Then a fatigue-in-reading reminder module is activated by the reading speed calculation module when the user's reading speed falls within a specific range so as to remind the user by pop-up windows, sounds, flash light or vibration at the proper time and provide the user certain corresponding measures he/she should take. Thereby there is no need to use additional equipment for preventing users from becoming more fatigue and healthy vision is accomplished at lower cost with higher efficiency.

12 Claims, 3 Drawing Sheets

(56) References Cited

U.S. PATENT DOCUMENTS

| | | | | |
|---|---|---|---|---|
| 2013/0041747 | A1* | 2/2013 | Anderson et al. | 705/14.39 |
| 2013/0283145 | A1* | 10/2013 | Argent | 715/231 |

FOREIGN PATENT DOCUMENTS

| | | |
|---|---|---|
| TW | 201229776 | 7/2012 |
| TW | 201249402 | 12/2012 |

* cited by examiner

METHOD AND SYSTEM FOR REMINDING READER OF FATIGUE IN READING WHILE USING ELECTRONIC DEVICE

BACKGROUND OF THE INVENTION

1. Fields of the Invention

The present invention relates to the method and system for reminding readers of fatigue in reading while using electronic devices, especially to the method and system for reminding readers of fatigue in reading while using electronic devices according to user's reading speed of reading behavior from the user's physiological point of view. The reading speed is obtained by analysis of pages being turned or the amount of words being read while users read. Once the user's reading speed falls in a specific range, a fatigue-in-reading reminder module of the system is triggered to remind the user and provide the user suggestions regarding measures he/she should take. Thus the user will not become more fatigue and the user's eyes are protected.

2. Descriptions of Related Art

Since the printing technique being invented by Johannes Gutenberg, human cultures have been recorded broadly and papers have played an important role in transfer of the knowledge. Reading is an important requirement needed for gaining information and knowledge. However, along with fast development of electronic technology, books are not the only source of knowledge. By Project Gutenberg founded in 1971, a plurality of literature whose intellectual property right have expired, or been forfeited have been digitalized in electronic form and available on internet to be download freely by readers. According to different types of media, information is transmitted in different ways. Through carriers such as internet, knowledge is distributed even more widely and effectively. Thus electronics such as electronic readers or electronic books have been developed for such purposes.

With the arrival of the digital era, digital resources have received more attention. The so-called digital resources means various information being digitalized, systematized and structured is read and utilized by users through different equipment. The digital resources include electronic books, electronic journals, paper database, electronic newspaper, etc. The electronic book is an important application of the digital resources. The invention and development of the electronic book represent a whole new field compared with books printed and published available now. Compared with conventional paper books, electronic books have advantages of elimination of print on paper and saving energy that takes during publication and production. Moreover, the electronic books have more file formats and this is helpful in spread and transfer of knowledge. In recent years, electronic books have played an important role on the book market. With the fast development and prevalence of electronic books, books in the electronic/digital form have become a mainstream. Yet it's also an important issue to learn the effects of such novel learning assistant tool (electronic books) on reader's physical and mental development. For example, if users use electronic readers or read electronic books for a long period of time, they will cause damages to eyesight. This is due to that most of new-generation electronic readers and electronic books have self-illuminating screens for showing content thereof.

In prior arts, refer to Taiwanese Pat. Pub. No. 201249402 "fatigue detection system and method thereof", a system for detecting fatigue is provided. At a certain interval, a camera is controlled to take a photo of a user that uses a computer. Then the user's facial parameters are analyzed and obtained. When the facial parameters are not within the reference range of the user not tired, the user is reminded to take a rest. Refer to Taiwanese Pat. Pub. No. 201229776 "electronic reader and control method thereof", a mechanism that detects fatigue in reading is revealed. While using electronic reader, a proximity sensor detects a distance between user's eye and the electronic reader to generate a distance sensing signal. The distance sensing signal is transmitted to a display control module so as to check whether the distance between the user and the electronic reader is over a preset value due to fatigue. Refer to Taiwanese Pat. Pub. No. M285339 "device for adjustment and amplification of crystalline lens", a proximity sensor is provided to detect the distance between user's eyes and the book so as to remind the user of fatigue in reading. However, the devices disclosed above are unable to remind the user at proper timing according to the user's conditions of fatigue. Thus how to remind the user of fatigue in reading effectively for preventing the user from feeling more fatigue and protecting user's eyes has become an important issue for manufacturers of electronic readers or electronic books.

In order to solve the problems of conventional electronic readers or electronic books such as users can only be reminded of fatigue in reading at a certain interval and the electronic readers/books are unable to detect users' reading behavior or reading speed for reminding of fatigue in reading, there is room for improvement and a need to provide a novel device.

SUMMARY OF THE INVENTION

Therefore it is a primary object of the present invention to provide the method and system for reminding readers of fatigue in reading while using electronic devices, especially to the method and system for reminding readers of fatigue in reading according to reader's reading speed of the reading behavior from the reader's physiological point of view. The reading speed is obtained according to pages being turned or the amount of words being read by readers. Once the reading speed falls in a specific range, a fatigue-in-reading reminder module of the system is triggered to remind the reader by pop-up windows, sounds, flash light or vibration and provide the reader suggestion related to the measures he/she should take. Thus the reader will not feel more fatigue and the reader's eyes are protected.

In order to achieve the above object, a method for reminding readers of fatigue in reading while using electronic devices of the present invention includes following steps. First detect user's reading speed within a period of time by a reading speed calculation module when the user is using an electronic with a display panel to read. The reading speed is related to pages being turned or the amount of words being read. Then a fatigue-in-reading reminder module is activated by the reading speed calculation module when the user's reading speed falls within a specific range so as to remind the user by pop-up windows, sounds, flash light or vibration at the proper time and give the reader certain suggestion regarding corresponding measures he/she should take. Based on the two-step method, a reading speed calculation module and a fatigue-in-reading reminder module are respectively worked in the step of calculating reading speed and the step of reminding fatigue in reading so that some measures users should carry out are suggested for fatigue reduction and effective eyesight protection.

The specific range can be less than 50 words being read per minute or more than 1000 being read words per minute. Then the fatigue-in-reading reminder module is going to remind users of fatigue in reading by one of the following ways including pop-up windows, sounds, flash light, vibration, etc at the proper time.

The specific range can also be 1-2 pages being turned per minute. Once the page being turned is less than 1-2 pages, the fatigue-in-reading reminder module reminds the user of the fatigue in reading problem by pop-up windows, sounds, flash light or vibration at the appropriate time.

Moreover, when the reading speed is 1000~9000 words being read per minute, the fatigue-in-reading reminder module can also be activated by the reading speed calculation module so as to provide the user corresponding measures he/she should take for reducing fatigue in reading The method for reminding readers of fatigue in reading while using electronic devices of the present invention can also be applied to devices for electronic books.

The method of the present invention is able to be connected/applied to various software, hardware, or their combinations. A part of the method of the present invention can be a code embedded in a medium. For example, the code can be a computer executable instruction or an application program on portable devices. The medium can be a floppy disk drive, optical disc drive, hard disk drive or other computer-readable storage medium. When the code is loaded into and executed by a device (such as a computer), the device executes the present invention. The computer generally includes a processor, a processor-readable storage medium (having volatile memory, non-volatile memory and/or storage element), at least one input device and at least one output device on the condition that the code is executed by a programmable computer.

The above method can be achieved by a system for reminding readers of fatigue in reading while using electronic devices. The system can be a software program or a hardware circuit. The system for reminding readers of fatigue in reading is composed of a reading speed calculation module and a fatigue-in-reading reminder module. The reading speed calculation module is used for calculating user's reading speed according to the pages turned or the amount of words read by the user within a period of time. As to the fatigue-in-reading reminder module, it is used to receive signals from the reading speed calculation module, remind the user of fatigue in reading by pop-up windows, sounds, flash light or vibration at the proper time once the user's reading speed falls in a specific range and further provide the user suggestions regarding the measure he/she should take. Thereby the user is reminded of fatigue in reading by the system so as to stop reading or change the reading behavior such as the reading speed for reducing fatigue in reading and caring user's vision. The system can be a built-in software appliance that reminds the users of fatigue in reading at the appropriate time from the user's physiological point of view so as to prevent the user from becoming more fatigue. The system doesn't need additional equipment such as cameras or proximity sensors of prior arts. Thus the user's eyesight is protected with reduced cost and higher efficiency.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
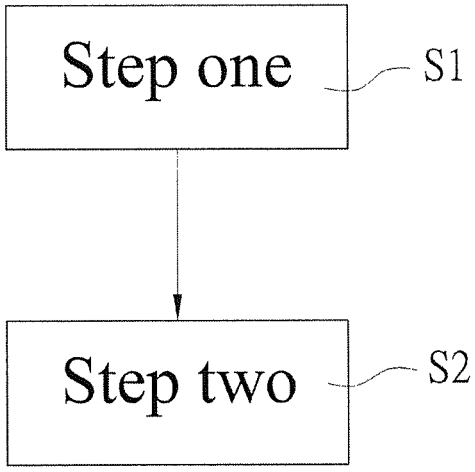
FIG. 1 is a flow chart showing steps of an embodiment of a method for reminding readers of fatigue in reading while using electronic devices according to the present invention.
Figure 2:
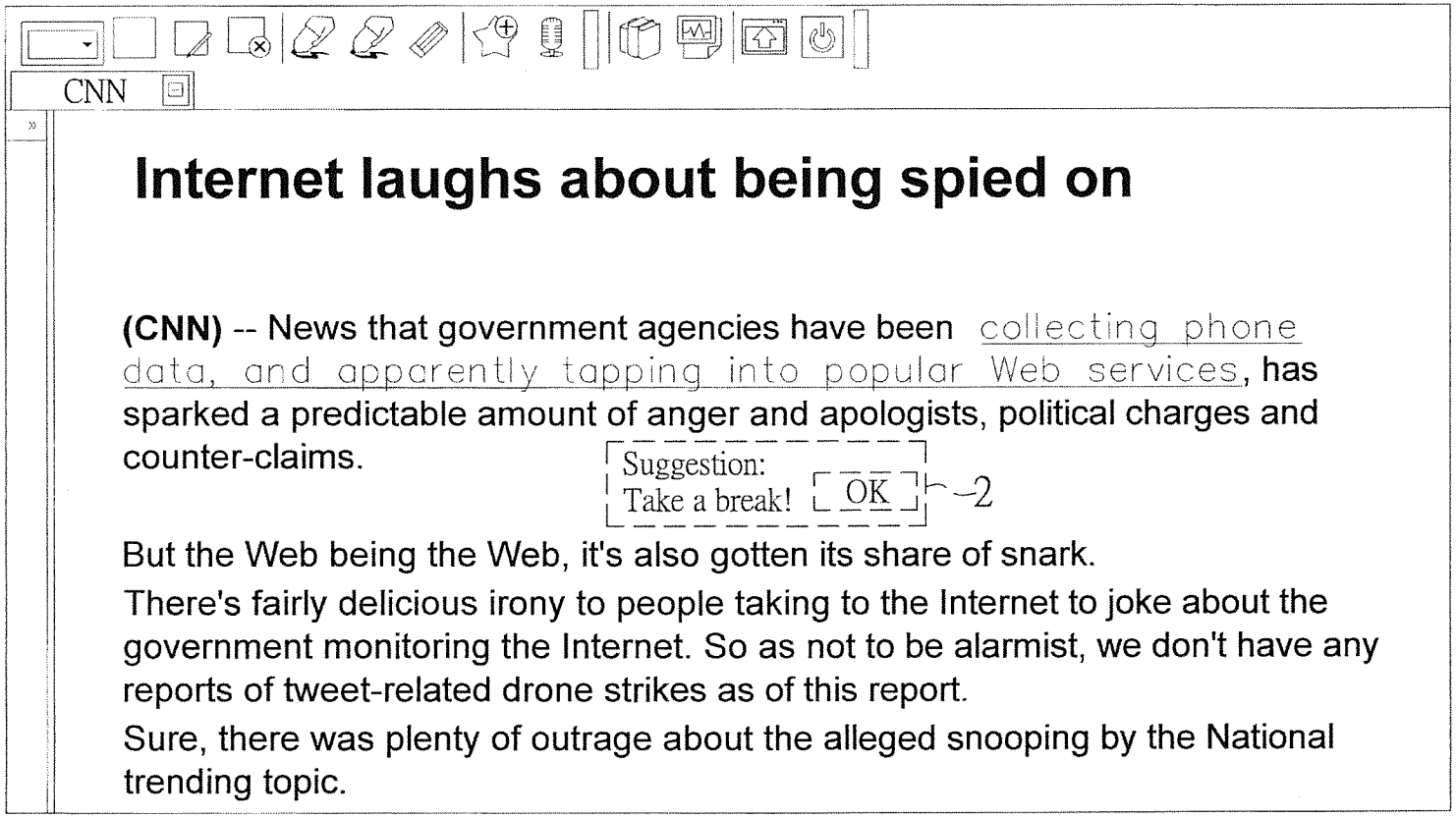
FIG. 2 is a schematic drawing showing an user's interface of an embodiment of a method for reminding readers of fatigue in reading while using electronic devices according to the present invention.

First refer to FIG. 1 and FIG. 2, a method for reminding readers of fatigue in reading while using electronic devices according to the present invention includes following steps.

Step one (S1): detecting user's reading speed within a period of time by a reading speed calculation module 1 while the user using an electronic with a display panel for reading. The reading speed is related to pages being turned or the amount of words being read.

Step two (S2): Triggering a fatigue-in-reading reminder module 2 by the reading speed calculation module 1 when the user's reading speed falls within a range of specific values so as to remind the user by pop-up windows, sounds, flash light or vibration at the proper time and provide the reader certain suggestions regarding measures he/she should take.

The specific range of reading speed is ranging from 50 to 1000 words being read per minute. When the amount of words the user read is less than 50 words being read per minute or more than 1000 words being read per minute, the reading speed calculation module 1 triggers the fatigue-in-reading reminder module 2 to remind the user of fatigue in reading by one of the following ways: pop-up windows, sounds, flash light and vibration at the appropriate time.

Moreover, the range of specific values of reading speed can also be 1-2 pages being turned per minute. When the page being turned is less than 1-2 pages, the fatigue-in-reading reminder module 2 also uses pop-up windows, sounds, flash light or vibration to remind the user of the fatigue in reading at the proper time.

Furthermore, when the reading speed is 1000~9000 words being read per minute, the fatigue-in-reading reminder module 2 can also be activated by the reading speed calculation module 1 so as to provide the user corresponding measures he/she should take for reducing fatigue in reading.

The method for reminding readers of fatigue in reading while using electronic devices of the present invention can also be applied to devices for electronic books In addition, the method of the present invention is able to be connected/applied to various software, hardware, or their combinations. A part of the method of the present invention can be an executable instruction embedded into computer readable medium, such as a computer executable instruction or an application program on portable devices. The computer readable medium includes electrical transmission module (electronic medium) with at least one cable, portable computer disk (magnetic medium), Random Access Memory (RAM, electronic medium), Read Only Memory (ROM, electronic medium), Erasable Programmable Read Only Memory (EPROM)/Electrically Erasable Programmable Read Only Memory (EEPROM)/Flash Memory (electronic medium), optical fiber (optical medium), Compact Disc Read-Only Memory (CDROM), etc. When the code is loaded into and executed by a device (such as a computer), the device becomes a system that executes the method for reminding readers of fatigue in reading while using electronic devices of the present invention. The computer generally includes a processor, a processor-readable storage medium (having volatile memory, non-volatile memory and/or storage element), at least one input device and at least one output device on the condition that the code is executed by a programmable computer.

Figure 3:
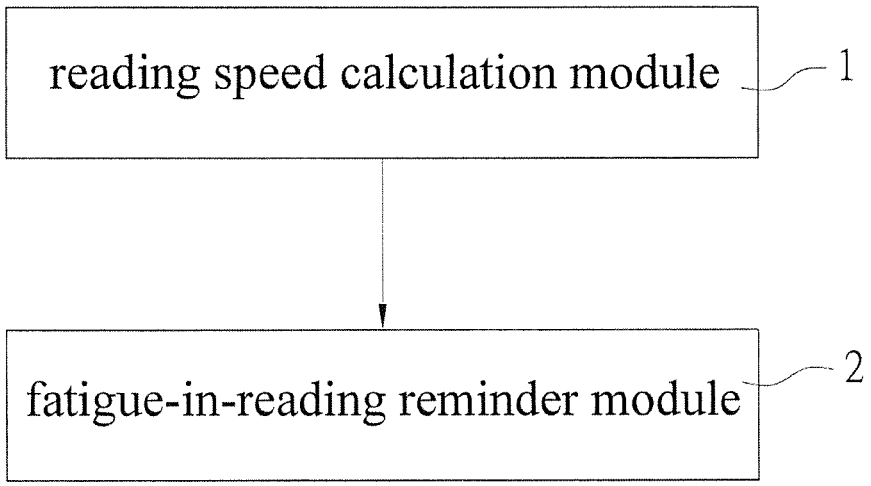
FIG. 3 is a schematic drawing showing system structure of an embodiment of a system for reminding readers of fatigue in reading while using electronic devices according to the present invention.

The steps of the flow chart of the method and system for reminding readers of fatigue in reading while using electronic devices mentioned above can be executed by a software system or a hardware system. Thereby a block diagram of a system for reminding readers using electronic devices of fatigue in reading is shown in FIG. 3. The system consists of a reading speed calculation module 1 and a fatigue-in-reading reminder module 2. The reading speed calculation module 1 is used to calculate the user's reading speed according to the pages turned or the amount of words read by the user within a period of time. The fatigue-in-reading reminder module 2 receives signals from the reading speed calculation module 1, reminds the user of fatigue in reading by one of the following ways: pop-up windows, sounds, flash light and vibration once the user's reading speed falls in a specific range and further provides the user suggestions regarding the measures he/she should take.

Compared with techniques available now, the present invention has following advantages:

1. The method and system for reminding readers of fatigue in reading while using electronic devices according to the present invention calculates user's reading speed, remind the user of fatigue in reading at proper time while reading electronic books and provide the user suggestions regarding measures he/she should take for reducing fatigue in reading from the user's physiological point of view. Thus more fatigue can be avoided and the user's eyes are protected effectively.
2. The method and system for reminding readers of fatigue in reading while using electronic devices according to the present invention are implemented by a built-in software appliance. No additional equipment such as the camera or the proximity sensor in prior arts is required. Thus the eyesight protection is achieved with lower cost and higher efficiency.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A method for reminding readers of fatigue in reading while using an electronic device with a display comprising the steps of:

step one: detecting a reader's reading speed within a period of time by a reading speed calculation module while the reader is using the electronic device for reading; the reading speed is related to pages being turned and an amount of words being read;

step two: triggering a fatigue-in-reading reminder module by the reading speed calculation module when the amount of words being read is below a first limit or is above a second limit, the second limit being greater than the first limit, or when the reading speed based on pages being turned falls within a range of specific values so as to remind the reader of fatigue in reading by pop-up windows, sounds, flash light or vibration at the proper time and provide the reader suggestions regarding measures the reader should take.

2. The method as claimed in claim 1, wherein the first limit is 50 words being read per minute and the second limit is 1000 words being read per minute.

3. The method as claimed in claim 1, wherein the range of specific values for the pages being turned is less than 1 to 2 pages being turned per minute.

4. The method as claimed in claim 1, wherein the first limit is 1000 words and the second limit is 9000 words being read per minute.

5. The method as claimed in claim 1, wherein the method is applied to devices for electronic books.

6. The method as claimed in claim 1, wherein an executable computer readable medium includes at least one computer executable module and the computer executable module having at least one computer executable instruction; the method is run when a computer executes the computer executable instruction.

7. A system for reminding readers of fatigue in reading while using an electronic device with a display comprising:

a reading speed calculation module that calculates the reader's reading speed according to pages being turned and an amount of words being read by the reader within a period of time;

a fatigue-in-reading reminder module that receives signals from the reading speed calculation module, reminds the reader of fatigue in reading by pop-up windows, sounds, flash light or vibration once the amount of words being read is below a first limit or is above a second limit, the second limit being greater than the first limit, or when the reading speed based on pages being turned falls in a specific range and further provides the user suggestions regarding measures he/she should take for the reader's reference.

8. The system as claimed in claim 7, wherein the first limit is 50 words being read per minute and the second limit is 1000 words being read per minute.

9. The system as claimed in claim 7, wherein the range of specific values for the pages being turned is less than 1 to 2 pages being turned per minute.

10. The system as claimed in claim 7, wherein the first limit is 1000 words and the second limit is 9000 words being read per minute.

11. The system as claimed in claim 7, wherein the system is applied to devices for electronic books.

12. The system as claimed in claim 7, wherein an executable non-transitory computer readable medium includes at least one computer executable module and the computer executable module having at least one computer executable instruction; the system is run when a computer executes the computer executable instruction.

* * * * *